United States Patent [19]

Ikeuchi et al.

[11] Patent Number: 4,783,008

[45] Date of Patent: Nov. 8, 1988

[54] ATOMIZER NOZZLE ASSEMBLY

[75] Inventors: Hiroshi Ikeuchi, Ashiya; Norio Oonishi, Nishiwaki, both of Japan

[73] Assignee: H. Ikeuchi & Co., Ltd., Osaka, Japan

[21] Appl. No.: 60,086

[22] Filed: Jun. 9, 1987

[30] Foreign Application Priority Data

Jun. 9, 1986 [JP] Japan ..... 61-134173

[51] Int. Cl.[4] ..... B05B 1/26; B05B 7/06; B05B 7/08

[52] U.S. Cl. ..... 239/421; 239/424; 239/543

[58] Field of Search ..... 239/290, 421, 424, 543, 239/544, 545, 422, 426

[56] References Cited

U.S. PATENT DOCUMENTS

| | | | |
|---|---|---|---|
| 1,398,397 | 11/1921 | Ryder et al. | 239/424 |
| 2,325,495 | 7/1943 | Ferguson | 239/424 X |
| 3,062,454 | 11/1962 | Cocks | 239/543 X |
| 3,093,315 | 6/1963 | Tachiki et al. | 239/424 |
| 3,219,276 | 11/1965 | Norris . | |
| 4,284,239 | 8/1981 | Ikeuchi . | |
| 4,415,123 | 11/1983 | Ikeuchi . | |

FOREIGN PATENT DOCUMENTS

| | | | |
|---|---|---|---|
| 368457 | 11/1906 | France | 239/424 |
| 54-111117 | 8/1979 | Japan . | |

*Primary Examiner*—Andres Kashnikow
*Assistant Examiner*—Mary Beth O. Jones
*Attorney, Agent, or Firm*—Wenderoth, Lind & Ponack

[57] ABSTRACT

An atomizer nozzle assembly for producing an extrafine mist of liquid includes a nozzle assembly, with a liquid passage hole of each nozzle tip of the assembly extending along a longitudinal axis of the nozzle tip. A front end opening of each liquid passage hole is centrally formed in the front end face of each nozzle tip. The angle of taper of a front tapered portion of each nozzle tip is 16°-24°. With the above arrangement, it is possible to produce a substantially ultrafine mist when the atomizing operation is started and it is also to produce an ultrafine mist having a constant particle diameter during a rise in the initial pressure of compressed air immediately following the start of atomization.

2 Claims, 8 Drawing Sheets

ATOMIZER NOZZLE ASSEMBLY

BACKGROUND OF THE INVENTION

1. Field of the Invention

The present invention generally relates to a nozzle for an atomizer which produces a jet of liquid in the form of a mist and, more particularly, to a nozzle assembly applicable to an ultrafine particle atomizer of a type which produces an extrafine mist of liquid, such as water, fuel oil, or medical solution, having a mean particle diameter (a Sauter mean particle diameter as referred to hereinafter) ranging from a submicron to some ten microns as most, or in other words, a dry mist which does not feel wet if touched (referred to hereinafter as an "ultrafine mist").

2. Description of the Related Art

Atomizers are employed in various fields for various purposes, such as humidifying, cooling, dust controlling, disinfectant solution spraying, and fuel oil atomizing. Generally, it is desirable that any mist produced by means of such a device should be an ultrafine mist. The reason is that of component particles of the mist are coarse, the surfaces of circumjacent objects will get wet in a given period of time when, for example, the atomizer is employed for humidifying purposes; and if the atomizer is employed for the purpose of disinfectant solution spraying, the circumjacent objects will get wet resulting in stains being left thereon.

The present inventor, after his series of studies on such a problem, found that for an ultrafine mist to be realized its component liquid particles must not have a maximum particle diameter greater than 50 microns and not have a Sauter mean diameter greater than 10 microns. On the basis of such a finding, the present inventor has already proposed various ultrafine mist producing atomizers (Japanese Published Unexamined Patent Application Nos. 54-111117, 55-49162, and 57-42362).

There are two types of nozzle assemblies, one or the other of which is employed in the ultrafine mist producing atomizers proposed by the present inventor. One type involves passing compressed air through a passage outside the nozzle tip, which may be called the outer air-passage type (Japanese Published Unexamined Patent Application Nos. 55-49162 and 57-42362). The other type involves passing compressed air through a passage defined within the nozzle tip, which may be called the inner air-passage type (Japanese Published Unexamined Patent Application No. 54-111117). From the standpoint of preventing the diffusion of a jet stream of a gas-liquid mixture from the nozzle orifice, it is generally believed that nozzles of the outer air-passage type are preferable.

As an illustration of a nozzle of the outer air-passage type, a general arrangement of the nozzle in the ultrafine mist producing atomizer disclosed in said patent publication No. 55-49162 is described below by way of example.

The basic arrangement of this nozzle is generally identical with that shown in FIGS. 1 and 2, on which one embodiment of the present invention is based. That is, a nozzle body has a plurality of nozzle heads arranged in an equi-spaced relation around the longitudinal axis thereof, each of the nozzle heads having a mounting hole in which a nozzle tip is mounted. Each nozzle tip, as can be seen from FIG. 12 (in which a part of a nozzle is shown), has a liquid passage hole 5*a*, while an air jet passage 5*e* is defined in a mounting hole 5*b* between a nozzle body 5*c* and the outer periphery of a nozzle tip 5*d*. Individual mounting holes and individual nozzle tips are so arranged that the respective longitudinal axes of the nozzle tips converge at one point on the longitudinal axis of the nozzle body, whereby as currents of compressed air are caused to jet out toward said one point on the longitudinal axis of the nozzle body passing, through the air jet passages, the currents suck liquid thereinto through the respective front end openings 5*f* of the liquid passage holes to form jet streams of a gas-liquid mixture and the jet streams impinge against one another at said one point on said longitudinal axis, thereby producing an ultrafine mist of liquid.

With respect to the above-described prior art nozzle arrangement, it must be noted that, as FIG. 12 shows, the front end openings 5*f* of the liquid passage hole 5*a* defined in each nozzle tip 5*e* are open at sides of the front end 5*g* of the tip and not on the front end 5*g* itself; that the angle of taper of a front end tapered portion 5*h* of the nozzle tip 5*d* is about 7°–22°; and that the front end of the nozzle tip 5*d* projects little, if any, from the nozzle body 5*c* (the amount of such projection being in the order of 0.2 mm at most).

Now, in the prior art nozzle arrangement, the relationship between compressed air pressure and liquid atomization rate is shown in FIG. 4*a* (conditions in FIG. 4 are: liquid pressure=0; liquid suction height=100 mm). In other words, there is no proportional relationship between compressed-air pressure and liquid atomization rate. In FIG. 4*a*, the mean particle diameter in the mist is about 50 microns—about 10 microns in a low pressure zone ranging from an initial air pressure at which atomization starts to a pressure level of about 3 kg/cm$^2$ with no ultrafine mist being available realized. An ultrafine mist having a mean particle diameter of less than about 10 microns is produced only in a high pressure zone in which the air pressure is in excess of about 3 kg/cm$^2$. However, as air pressure becomes higher, the mean particle diameter becomes smaller, and as shown in FIG. 4*a*, atomization is terminated when an air pressure of less than 4 kg/cm$^2$ is reached. With prior art arrangement, therefore, one problem is that at on/off control stages for compressed air supply, a mist having a relatively coarse particle size is produced, so that the floor and circumjacent surfaces get wet. Another problem is that when only a small amount of ultrafine mist is required, it is necessary to increase the air pressure, which means a disproportionally greater amount of air consumption for the liquid atomization is required which is extremely uneconomical. A further problem is that the diameter of particles in the mist varies with changes in the air pressure, or in other words, a mist having a constant particle diameter cannot be produced.

These problems are considered to be attributable to the front end structure of the nozzle and, more particularly, to the fact that a negative pressure develops thereat as a compressed air current passes at a supersonic velocity through the nozzle orifice.

SUMMARY OF THE INVENTION

It is, therefore, an essential object of the present invention is to provide an atomizer nozzle assembly having an improved front end structure which is likely to cause a negative pressure and a satisfactory pattern of compressed air flow which enables a substantially ultrafine mist to be produced at a point of time when atomization is initiated under an initial pressure of compressed air, and which enables an ultrafine mist to be produced when a slightly higher level of air pressure is reached, at a flow rate generally proportional to the pressure rise.

In accomplishing this and other objects, according to the present invention, there is provided an atomizer nozzle assembly comprising the following arrangement:

a nozzle assembly generally identical with the above-described prior-art arrangement, but in which a liquid passage hole of each nozzle tip extending along the longitudinal axis of the nozzle tip has a front end opening centrally formed in the front end of the nozzle tip and the angle of taper of a front tapered portion of each nozzle tip is 16°-24°.

Such an arrangement of the invention is based on findings derived from certain experiments which will be described hereinafter. With such an arrangement it is possible to produce a substantially ultrafine mist at the start of the atomizing operation and also to produce an ultrafine mist having a constant particle diameter during rise in the initial pressure of compressed air immediately following the start of atomization.

Therefore, according to the invention, there will be no generation of any coarse particle mist at on/off stages for compressed air jetting, and thus there is no possibility of the mist causing the floor and other circumjacent surfaces to become wet. Furthermore, with a rise in the pressure of compressed air, an ultrafine mist having a generally uniform particle diameter can be produced at a rate proportional to the pressure rise.

In the foregoing arrangement, it is desirable that the front end of each nozzle tip should project forward from the front end of the corresponding nozzle tip, and that the length of such projection be set within the range of 0.3–0.8 mm. With such an arrangement, it is possible to ensure stable atomization. That is, by arranging the front end of each nozzle tip so that it projects forward more than 0.3 mm, it is possible to produce a steady jet stream of a gas-liquid mixture, because droplets of liquid sucked outward from the liquid passage hole become less inclined to be attracted toward an enlarged portion defined between the front tapered portion of the nozzle tip and the interior of the nozzle head, that is, in a back flow direction, while on the other hand by limiting the length of the nozzle tip projection to not more than 0.8 mm it is possible to control the maximal diameter of liquid particles in a mist to not more than 50 microns, the permissible maximum particle diameter for realizing an ultrafine mist.

It is to be noted in this conjunction that if the front end opening of the liquid passage hole in the nozzle tip is reverse tapered, it is possible to obtain an ultrafine mist having a more uniform particle diameter.

BRIEF DESCRIPTION OF THE DRAWINGS

This and other objects and features of the present invention will become apparent from the following description taken in conjunction with the preferred embodiment thereof, with reference to the accompanying drawings, in which.

DETAILED DESCRIPTION OF THE PREFERRED EMBODIMENT

One preferred embodiment of the present invention will now be described in further detail in conjunction with experimental examples.

Figure 1:
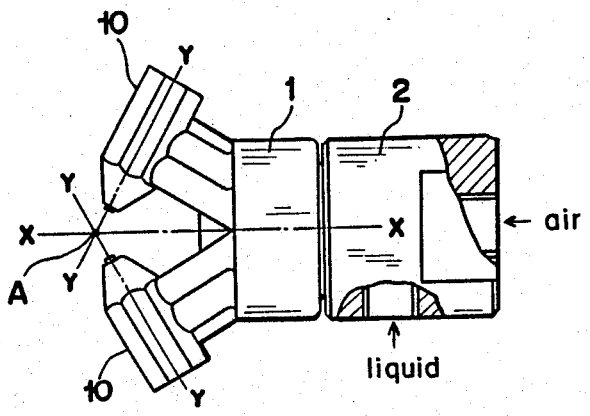
FIGS. 1 and 2 are, respectively, a side view and a right end view, both showing an atomizer nozzle assembly in accordance with the invention.
Figure 2:
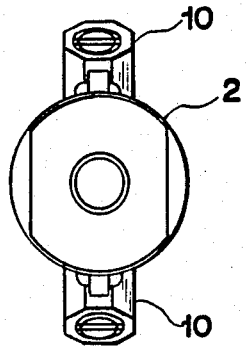

FIGS. 1 and 2 illustrate general aspects of a nozzle assembly in accordance with the invention. The nozzle assembly consists generally of a nozzle body (1) and and adapter (2) for air and water supply which is connected to the nozzle body 1. The nozzle body 1 has a plurality of nozzle heads (10) arranged in equi-spaced relation around its center, that is, the longitudinal axis (X—X) thereof.

The number of nozzle heads (10) is not particularly limited. In the present embodiment, the nozzle body (1)

has two nozzle heads. That is, the nozzle assembly has a two-head nozzle construction.

Figure 3A:
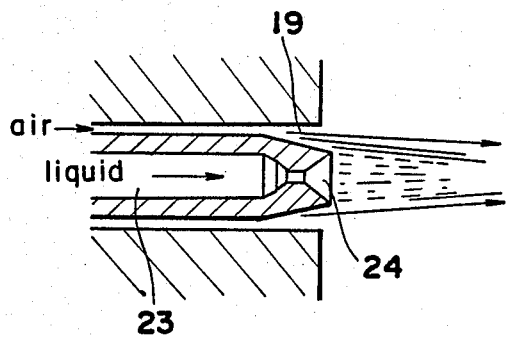
FIG. 3*a* is a fragmentary sectional view showing a modified form of the nozzle in FIG. 3*b;*
Figure 3B:
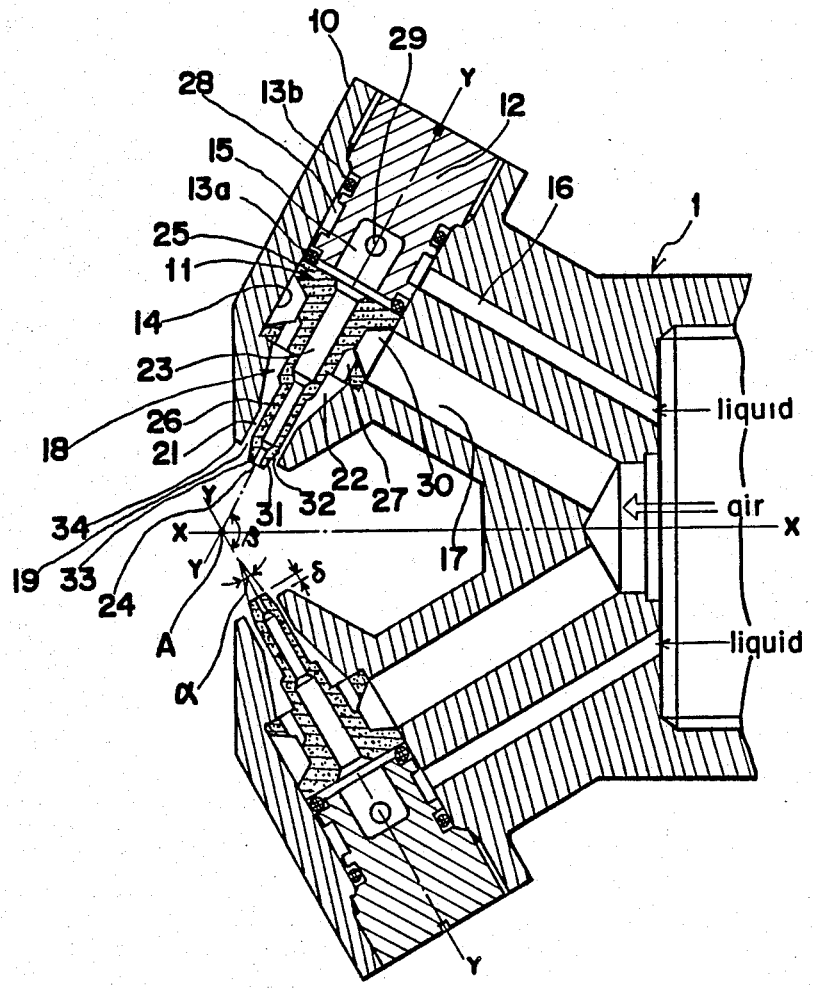
FIG. 3*b* is an enlarged longitudinal section view showing the nozzle in FIGS. 1 and 2.

FIG. 3*b* is an enlarged sectional view of the nozzle body (1) shown in FIGS. 1 and 2. As shown, each nozzle head (10) of the nozzle body 1 has an air introduction path (17) for introducing compressed air thereinto, and a liquid introduction path 16 for introducing liquid, such as water of disinfectant solution, according to the purpose for which the atomizer is to be employed. The air introduction path (17) and the liquid introduction path (16) are respectively connected at one end to a compressed air introduction path and a liquid introduction path, both formed in the adapter 2.

Each nozzle head (10) has a mounting hole (14) in which a a nozzle tip (11) is housed or mounted. As shown, the nozzle tip (11) is housed in the mounting hole (14) at the front end side thereof, and is fixed by a plug (12) housed in the hole (14) at the rear end side thereof.

Individual nozzle heads (10) and individual nozzle tips (11) housed therein are arranged so that the respective longitudinal axes (Y—Y) of the nozzle tips (11) converge at one particular point (A) on aforesaid longitudinal axis (X—X). Generally, the angle ($\beta$) at which a pair of longitudinal axes (Y—Y), (Y—Y) intersect each other is preferably set at 70°-160°. The distance between a pair of nozzle orifices is generally preferably set at 3-15 mm.

The mounting hole (14) in each nozzle head (10) has a generally cylindrical configuration, and its front end portion includes a forwardly tapered portion (22) and a discharge port (19) having a smaller diameter cylindrical configuration and contiguous with the tapered portion (22).

Each nozzle tip (11) consists generally at a large diameter base portion (25) and a small diameter front portion (26). The liquid passage hole (23) of the nozzle tip (11) extends along the longitudinal axis (Y—Y) of the nozzle tip (11) and has a front end opening (24) which is open centrally in the front end (33). This front end opening (24) may have a straight configuration as shown in FIG. 3*b*, or may have a slightly divergent configuration as shown in FIG. 3*a*. The large diameter base portion (25) is in contact with the cylindrical interior of nozzle head (10) defining the mounting hole (14), while the small diameter front portion (26) projects slightly outward passing through the tapered portion (22) of the mounting hole (14) and then through the discharge port (19) (the length of projection=$\delta$). The large diameter base portion (25) of each nozzle tip (11) has a circumferential groove or communicating groove (30) formed on its outer periphery, and also has a communicating hole (27) which extends between the communicating groove (30) and the space in the tapered portion (22) of the mounting hole (14). The air introduction hole (17) is open to the communicating groove (30) so as to be in communication therewith. Accordingly, the compressed air supplied through the air introduction hole (17) is allowed to pass along an air discharge path (18) defined adjacent the outer periphery of the small diameter front portion (26), that is, through the tapered portion (22) and the discharge port, via said communicating groove (30) and said communicating hole (27), until it is jetted out. The small diameter front portion of the nozzle tip (11) extends in the discharge port (19) to form a throat portion (21) relative to the tapered portion (22), while the outer periphery of the small diameter front portion (26) of the nozzle tip (11) is forwardly tapered at the front end thereof so that the front end of the discharge port (19) is enlarged to form an enlarged portion (32). Therefore, the velocity of the compressed air to be jetted out reaches a sonic velocity level by causing the compressed air to pass through the throat portion (21), and when the air reaches the enlarged portion (32) of the discharge port (19), negative pressure is developed.

On the outer periphery of the plug (12) are mounted a pair of O-rings 13*a*, 13*b* in spaced apart relation, with a circumferential groove or communicating groove (28) formed between the pair of O-rings 13*a*, 13*b*. The liquid introduction path (16) is open into the communicating groove (28). The plug (12) has a center hole (15) in the center thereof at the front end side, and a communicating hole (29) extends between the center hole (15) and the communicating groove (28). Accordingly, the liquid supplied into the liquid introduction path (16) is guided into the liquid passage hole (23) of the nozzle tip (11) after passing through the communicating groove (28), communicating hole (29), and center hole (15) in that order.

Now, if the operation of the device is begun by supplying liquid (liquid pressure=0) and compressed air to the nozzle assembly of the above-described construction, the compressed air sucks liquid droplets thereinto from the front end opening (24) of the nozzle tip (11) as it is jetted out from the discharge port (19), so that a jet stream of a gas-liquid mixture is realized. At this time, droplets of liquid are sheared by the compressed air into fine particles. Jet streams of a gas-liquid mixture discharged from the individual nozzle heads impinge against each other at one point (A) on the longitudinal axis (X—X), whereby a process of mutual shearing is repeated and simultaneously a supersonic wave of 20,000-40,000 Hz is generated, with the result of the droplets being reduced to finer particles. Thus, an ultrafine mist composed of microfine particles is released forward.

(Experimental Example 1)

With careful attention directed to the fact that in the nozzle assembly having the above-described construction, the angle of taper ($\alpha$) at the front end portion of the nozzle top (11) is a factor having an important bearing on the flow pattern of compressed air and the magnitude of the resulting negative pressure, the present inventor conducted experiments with a variety of changes in the angle of taper ($\alpha$) and found out several facts of great interest. The experiments are explained in detail hereinbelow.

Experiment Conditions

Nozzle tips, each having a front end diameter of 1.3 mm and a liquid passage hole diameter of 0.4 mm, were mounted to a double head jet nozzle body (1) having a pair of discharge ports (an inter-discharge port distance: 8 mm, an intersecting angle ($\beta$): 120°), in such a way that the front end of each nozzle tip (11) projected forward 0.3 mm from the corresponding discharge port (19) of the nozzle body (1) and that the throat portion (21) between the nozzle body (1) and the nozzle tip (11) had a sectional area of 0.5 $mm^2$ for allowing the passage of compressed air. The angle of taper ($\alpha$) at the front tapered portion of the nozzle tip was varied in order to find out the relationship between the angle of taper ($\alpha$) and maximal particle diameter (FIG. 5), the relationship between air pressure and liquid atomization rate (FIG.

Figure 6:
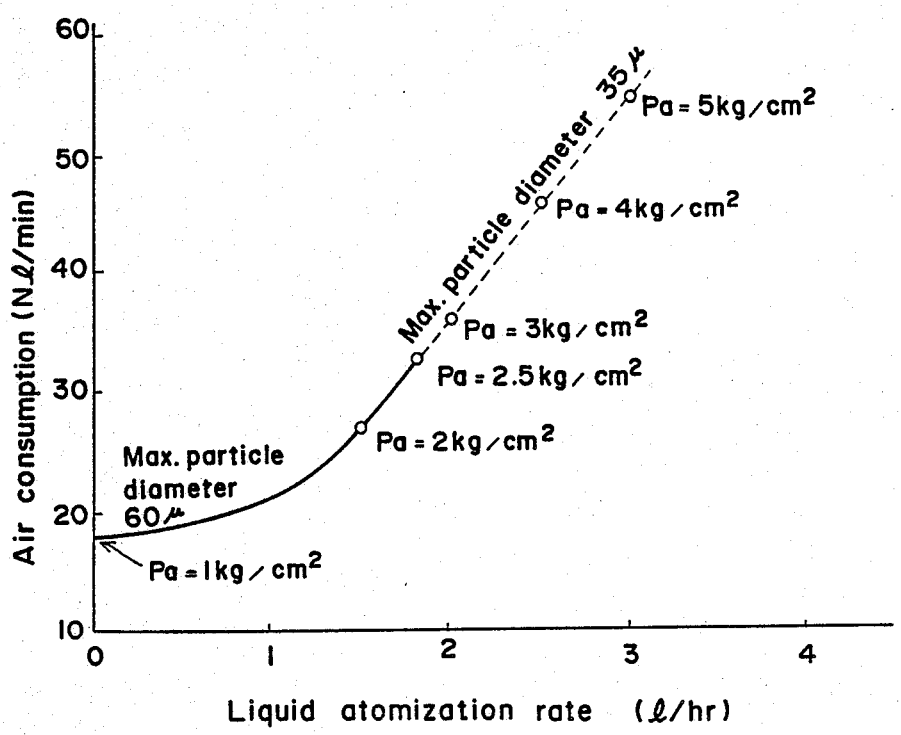
FIG. 6 is a graph showing the relationship between liquid atomization rate (abscissa) and air consumption (ordinate) on the basis of the results of experiments conducted by employing the nozzle of the present invention.
Figure 7A:
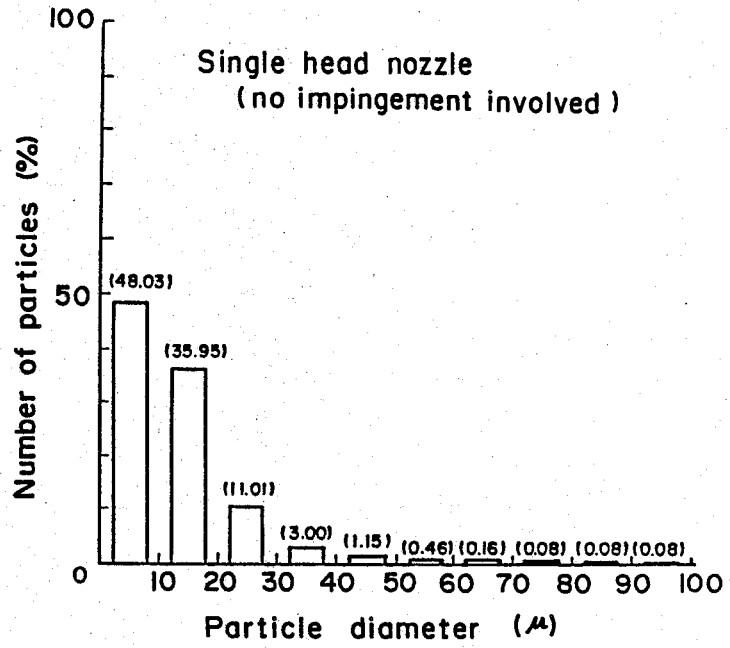
FIG. 7*a* is a graph showing the relationship between particle diameter (abscissa) and number of particles (ordinate) when one of the discharge ports in the nozzle assembly according to the present invention was closed so that the nozzle assembly was employed as a single-head nozzle.
Figure 7B:
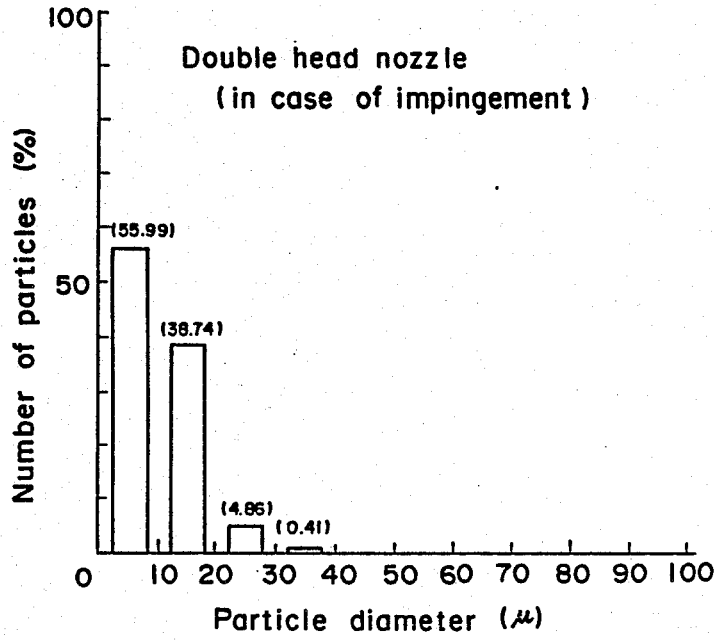
FIG. 7*b* is a graph showing the relationship between particle diameter (abscissa) and number of particles (ordinate) when the double head nozzle according to the present invention was employed as such.

4b), the relationship between liquid atomization rate and air consumption (FIG. 6), and particle diameters in mists produced (FIGS. 7a and 7b). The liquid pressure was set at 0, and the height of liquid suction at 100 mm.

Experimental Results

Figure 5:
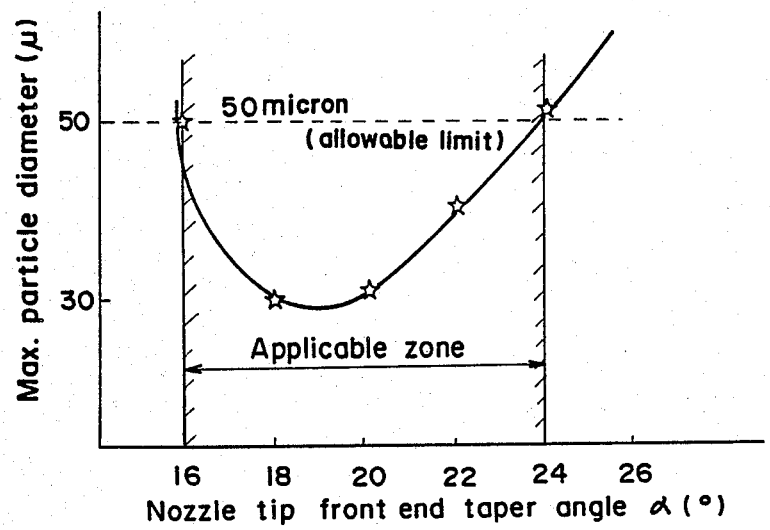
FIG. 5 is a graph showing the relationship between the angle of taper (α) at the nozzle tip front end (abscissa) and maximal liquid drop particle diameter (ordinate) on the basis of the results of experiments conducted by employing the nozzle of the present invention.

As can be seen from FIG. 5, under the air pressure condition of 3 kg/cm$^2$, the maximal particle diameter was more than 50 microns (with mean particle diameter of more than about 10 microns) if the angle of front end taper ($\alpha$) was less than 16° or in excess of 24°, and with such conditions (maximal particle diameter of not more than 50 microns) an ultrafine mist was accordingly not produced. When the angle of taper ($\alpha$) was in the vicinity of 20°, the maximal particle diameter was reduced to a minimum, say, about 30 microns (with mean particle diameter of 8 microns). When the angle of taper ($\alpha$) was within the range of 16°–24°, the conditions for producing an ultrafine mist was satisfied. This can be explained by the fact that, as FIG. 5 shows, when the angle of taper was in the vicinity of 20°, drops of liquid sucked under a negative pressure were first diverged, but were subsequently caused to impinge upon one another in a well contracted condition under currents of air discharged at a supersonic velocity. This is, if the taper angle ($\alpha$) was excessively small, currents of air discharged were diverged under the influence of the circumjacent air resistance, and accordingly the jet streams were also diverged and slowed down, so that drops of liquid became coarse. If the taper angle ($\alpha$) was excessively large, compressed air was separated without being allowed to run along the tapered portion, and therefore jet streams were not well contracted. Thus, the density of impingement energy was substantially reduced with the result of liquid drops becoming coarse.

On the basis of the above-described results, it can be said that if the angle of taper ($\alpha$) at the front end of the nozzle tip is set within the range of 16°–24°, it is possible to obtain an ultrafine mist with a maximal particle diameter of not more than 50 microns. The provision of a liquid passage hole in the nozzle tip at the front end side thereof facilitate an effect in which the higher the pressure of compressed air, the larger is the negative pressure in the liquid passage hole. Thus, it is possible to increase the liquid atomization rate in proportion to the rise in the air pressure. The present invention is based on these experimental results.

FIG. 6 shows, by way of example, the relationship between liquid atomization rate and air consumption when the taper angle ($\alpha$) is set at 18°. In this case, atomization starts under an air pressure (Pa) of 1 kg/cm$^2$, and the liquid atomization rate continues to increase notably in relation to the rate of air consumption until an air pressure of 2kg/cm$^2$ is reached. When air pressure is increased to a level of more than 2 kg/cm$^2$, the rate of air consumption tends to increase in proportion to the rise in air pressure. Where the air pressure is between 1 kg/cm$^2$ and 2 kg/cm$^2$, there is not sufficient negative pressure to provide any sufficient shearing action of sucked liquid droplets; therefore, the liquid drops are rather coarse and, even after their impingement, the maximal particle diameter is in the vicinity of 60 microns, a value somewhat larger than the maximal particle size for realizing an ultrafine mist. However, when the air pressure is greater than 2.5 kg/cm$^2$, a negative pressure corresponding to the liquid atomization rate results, so that the maximal diameter of liquid particles after impingement is not more than some 35 microns, a perfect ultrafine mist thus being realized.

Figure 4A:
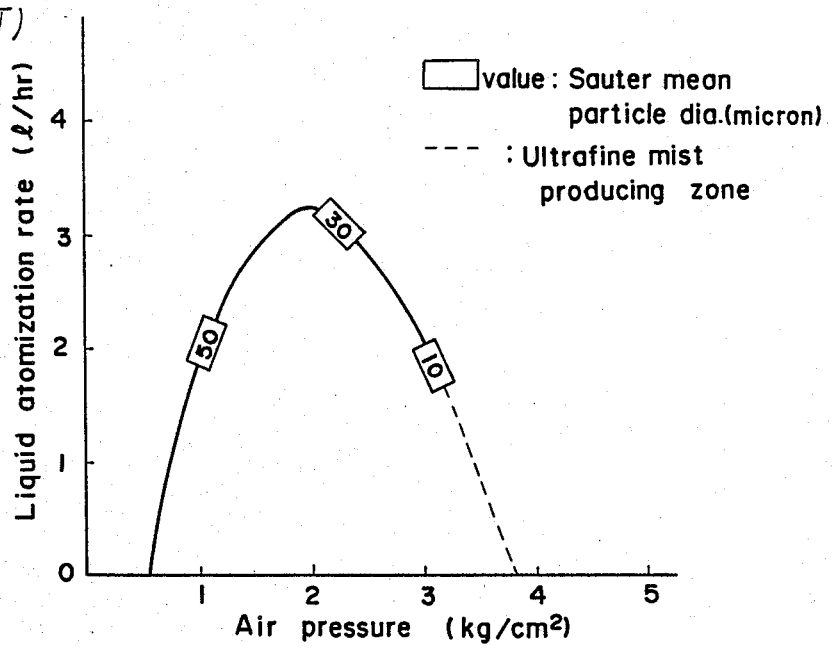
Fig. 4a (PRIOR ART)
FIG. 4*a* is a graphic representation showing the relationship between air pressure (abscissa) and liquid atomization rate (ordinate) in the prior art nozzle shown in FIG. 12.
Figure 4B:
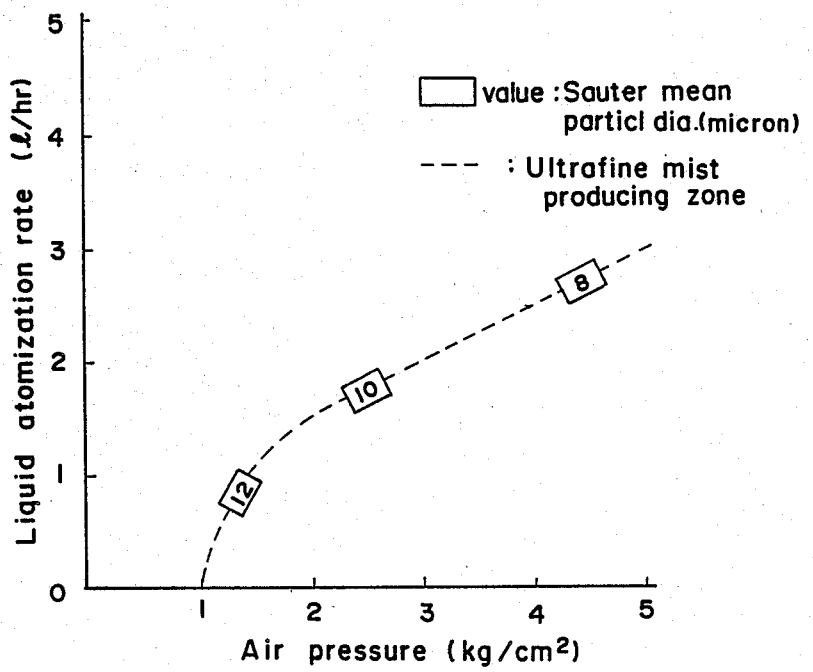
FIG. 4*b* is a graph showing the relationship between air pressure (abscissa) and liquid atomization rate (ordinate) on the basis of the results of experiments conducted by employing the nozzle of the present invention.

FIG. 4b shows the data of FIG. 6 in terms of the relation between air pressure and atomization rate. An ultrafine mist is produced when the pressure of compressed air is more than 2.5 kg/cm$^2$, the Sauter mean particle diameter being 10 microns. When the pressure is less than 2.5 kg/cm$^2$, the mean particle diameter is 12 microns, which is slightly coarser. That is, even at on/-off stages of nozzle operation, no coarse particle mist is produced, and there is little or no possibility of the mist creating wetness on a floor and any other circumjacent surface.

In the above-described experiment, jet streams of a gas-liquid mixture were jetted out simultaneously from a pair of discharge ports so that they were impinged against each other. In order to further clarify the fact that particle diameters of the mist produced in such a case were very fine and uniform, the above results were compared with those obtained when one of the discharge ports were sealed and jetting was effected from the other discharge port only. FIG. 7a shows results of atomizing operation with a single head nozzle, and FIG. 7b shows results of operation with a double head nozzle. In both cases, examination was made under an air pressure of 3.0 kg/cm$^2$. With the single head nozzle, coarse particles having a maximum particle diameter of more than 90 microns were produced, whereas with the double head nozzle, the maximum particle diameter was in the order of 35 microns at most. In the latter case, more than one half of the particles produced had a particle diameter of several microns and some 95% of the particles produced had a particle size of ten and odd microns, the particles as a whole being very fine and uniform.

(Experiment 2)

In addition to Experiment 1, the present inventor conducted a second experiment. Attention was paid to the fact that the amount of projection ($\delta$) from the nozzle body (1) of the nozzle tip (11) at the front end thereof is another factor which determines the magnitude of a negative pressure produced as a result of compressed air passage. In this experiment, the amount of such projection was varied. It was found that where the amount of projection was within the range of 0.3–0.8 mm, atomization could be effected most steadily.

Experiment Conditions

The experiment conditions applied were basically the same as those in Experiment 1. In this case, however, the angle of taper at the front end of the nozzle tip (11) was set at 18°, and the amount of projection ($\delta$) was varied in several increments.

Experimental Results

Figure 8A:
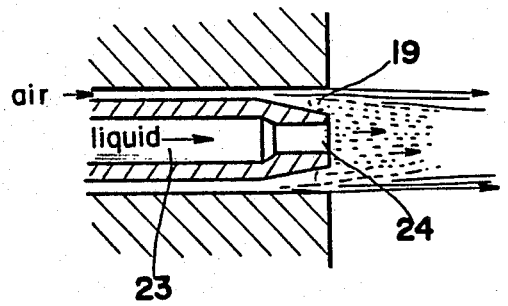
FIG. 8*a* is an explanatory view showing the condition of gas-liquid flow when the front end of the nozzle tip projects very little from the nozzle body.
Figure 8B:
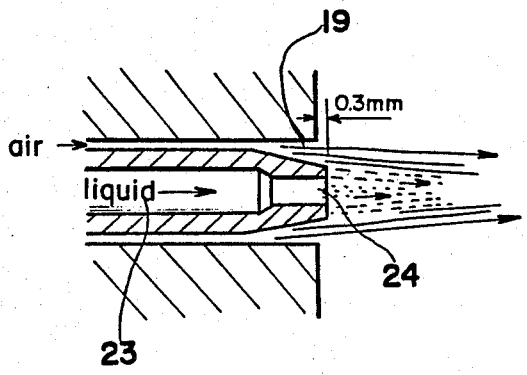
FIG. 8*b* is an explanatory view showing the condition of gas-liquid flow when the front end of the nozzle tip projects forward 0.3 mm from the nozzle body.
Figure 9A:
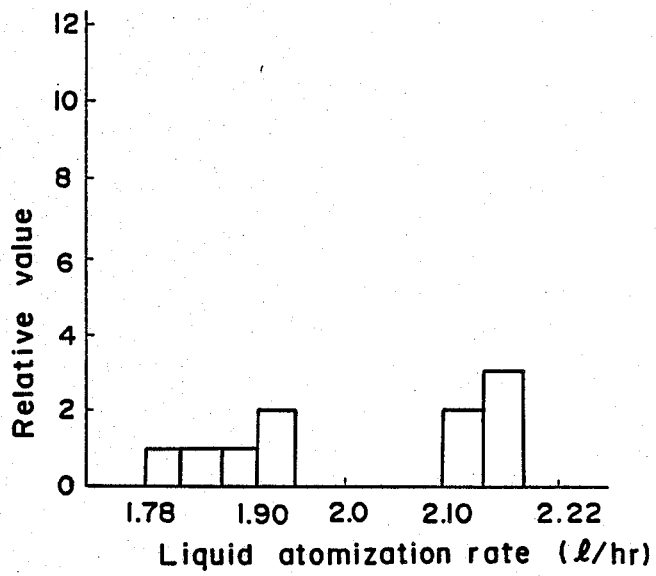
FIG. 9*a* is a graph showing the relationship between liquid atomization rate (abscissa) and degree of angle (ordinate) according to FIG. 8*a;*

In the above experiment 2, the pressure of compressed air was first set at 3.0 kg/cm$^2$, and the amount of projection of the nozzle tip front end was increased sequentially from zero to 0.3 mm. FIG. 8a shows the condition of gas/liquid flow when the amount of projection was zero, and FIG. 8b shows the condition of gas/liquid flow when the amount of projection was 0.3 mm. As is apparent from FIG. 8a, when the projection amount was zero, a negative pressure is produced as compressed air is jetted out from the discharge port (19) at a supersonic velocity, and simultaneously upon liquid drops being sucked from the front end opening (24) of the liquid passage hole (24), the liquid is first drawn into the discharge port (19) and then jetted out in conjunction with compressed air. This phenomenon dimishes gradually as the projection amount is increased, and almost ceases to exist when the amount of projection is increased to about 0.3 mm. If the phenomenon shown in FIG. 8*a* develops, a serious problem arises which may adversely affect the stability of atomization. That is, if such phenomenon develops impurities contained in the liquid, such as silica, silicon, and magnesium, deposit on the sides of the nozzle tip over time, with the result that the desired atomization rate relative to the predetermined pressure of compressed air cannot be maintained. FIG. 9*a* shows such unfavorable results. In this instance, while the atomization rate is at 2.0 l, it is apparent that actual rate of atomization is scattered on both the + side and the −side, with 2.0 l as a border line. As deposition of such impurities increases, a problem of blinding of the discharge port (19) will develop.

If the amount of projection is set at about 0.3 mm as shown in FIG. 8*b*, the effect of a negative pressure, if any, is insignificant and drops of liquid sucked from the liquid passage hole (23) do not spread except on the front end (33) of the nozzle tip; therefore, if such impurity deposition does occur at all, it only affects the tip front end (33), and it is very easy to remove such deposit.

Figure 9B:
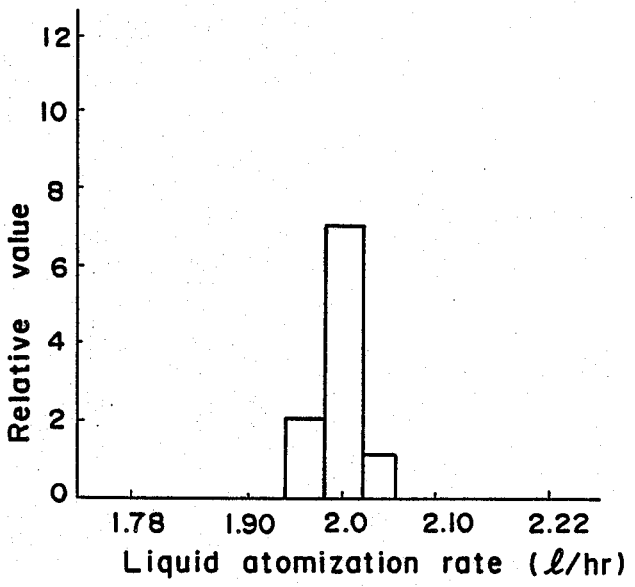
FIG. 9*b* is a graph showing the relationship between liquid atomization rate (abscissa) and degree of angle (ordinate) according to FIG. 8*b;*

Therefore, the flow of liquid drops is stabilized so that a uniform atomization rate can be assured. FIG. 9*b* shows the results obtained where the nozzle in FIG. 8*b* was used. It can be clearly seen that the rate of atomization corresponds generally to the atomization rate setting of 2.0 l/hr.

Hence, it is desirable that the amount of projection at the front end of the nozzle tip be set at more than 0.3 mm, but with the increase in the amount of such projection, particle diameters in a mist tend to become larger. In order to obtain an ultrafine mist, there is a certain limitation on the amount of such projection.

Figure 10:
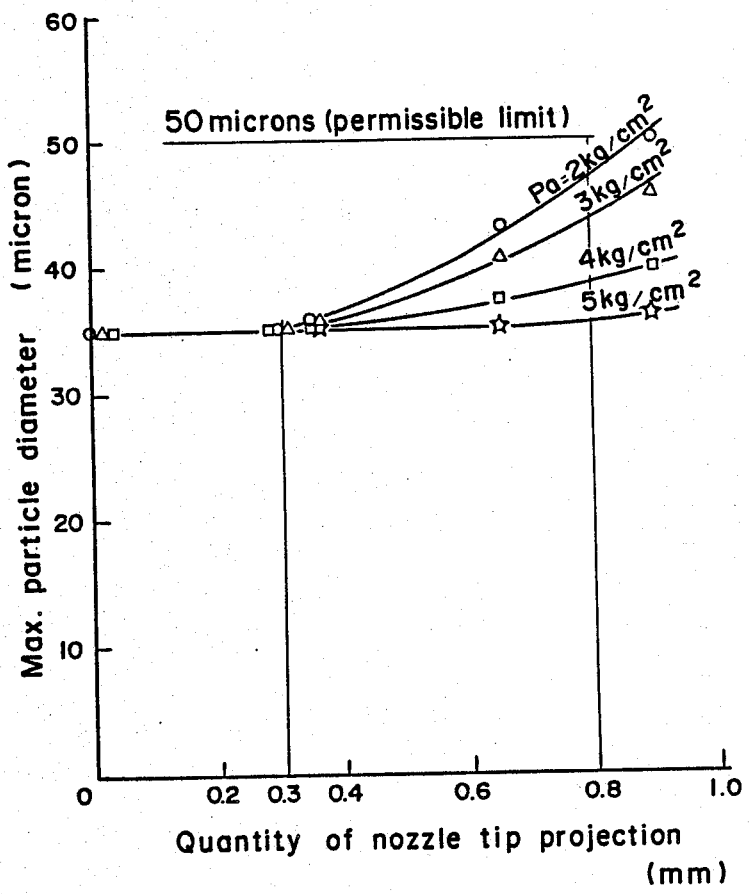
FIG. 10 is a graph showing the relationship between the amount of nozzle tip projection (abscissa) and maximal particle diameter (ordinate)

In view of these facts, the relationship between the quantity of projection (δ) at the front nozzle tip end and mist particle diameter was examined using the pressure of compressed air as a parameter. FIG. 10 shows the results thereof.

As FIG. 10 shows when the projection is within the range of 0.3 mm–0.8 mm, the maximal particle diameter is 35 microns to less than 50 microns, necessary conditions for producing an ultrafine mist being fully met. However, if the projection is in excess of 0.8 mm, the maximum particle diameter is more than 50 microns, said conditions not being satisfied.

Therefore, an optimum range of nozzle tip front-end projection lengths is from 0.3 to 0.8 mm.

(Experiment 3)

Figure 12:
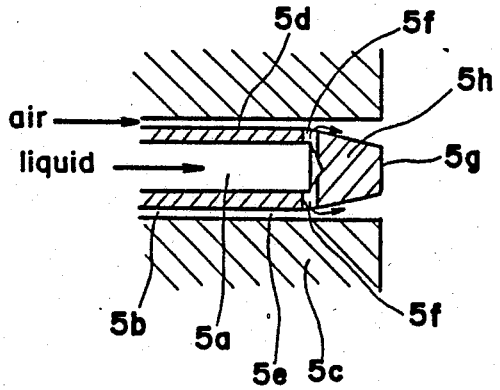
Fig. 12 PRIOR ART
FIG. 12 is a fragmentary sectional view showing a prior-art nozzle, as previously described.

The prior art nozzle arrangement shown in FIG. 12 is subject to a problem in which a temperature drop may occur as a result of compressed air expansion in the discharge port (19), resulting in possibilities of the liquid drops freezing at the discharge port. Experiments were made in order to find how well this problem could be solved by this invention. The results were found satisfactory.

Figure 11:
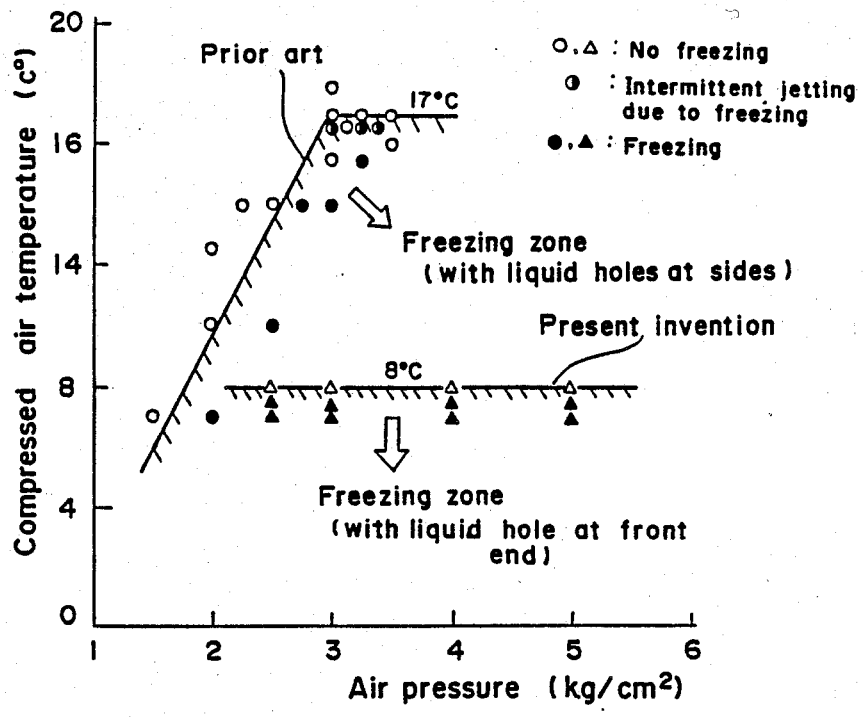
FIG. 11 is a graph showing the relationship between air pressure (abscissa) and compressed air temperature (ordinate), and also showing liquid droplet freezing temperatures.

In this experiment, the prior art nozzle in FIG. 12 and the nozzle employed in Experiment 2 (with the nozzle tip projection set at 0.3 mm) were both employed, and droplet freeze initiation temperature were compared between the two nozzles while varying compressed air temperatures. The results are shown in FIG. 11. As can be seen, if the air pressure is more than some 3 kg/cm$^2$, freezing starts at some 17° C. with the prior-art nozzle, whereas freezing starts at about 8° C. in the present invention. In other words, the compressed air freezing temperature observed with the nozzle of the invention is about 9° C. lower than that observed with the prior art nozzle. Therefore, the nozzle in accordance with the invention is advantageous in that no preheating of compressed air is required in a normal range of uses.

Although the present invention has been fully described by way of example with reference to the accompanying drawings, it is to be noted here that various changes and modifications will become apparent to those skilled in the art. Therefore, unless such changes and modifications depart from the scope of the present invention, they should be construed as included therein.

What is claimed is:

1. In an atomizer nozzle assembly for facilitating atomization of a liquid, said assembly including a nozzle body having a longitudinal axis and a plurality of nozzle heads equally spaced apart from one another around said longitudinal axis, each said nozzle heads having a mounting hole extending therein, a nozzle tip disposed in said mounting hole, the nozzle tip having a longitudinal axis, and an air jet passage defined therein between the inner periphery of the nozzle head and the outer periphery of said nozzle tip, said air jet passage communicable with a source of compressed air and open at a front end of the nozzle head for allowing currents of compressed air to be jetted therethrough, the longitudinal axes of said nozzle tips extending in respective directions that converge at a point of impingement located on the longitudinal axis of said nozzle body, the improvement comprising:

ultrafine mist producing means for enabling an ultrafine mist to be produced from the liquid when atomization of the liquid is initiated by the flow of compressed air forced under an initial pressure through said air jet passage of each said nozzle heads and for causing the ultrafine mist to be continuously produced, as said initial pressure is increased, with the liquid flowing at a flow rate that is proportional to the increase in said initial pressure, said ultrafine mist producing means comprising respective forward end portions of each of said nozzle tips that are tapered in said respective directions, the angle of taper being in the range of 16° to 24°, and respective liquid passage holes extending in each of said nozzle tips along the longitudinal axes thereof, said liquid passage hole open between a source of the liquid and respective front faces of the forward end portions of the nozzle tips that face said point of impingement for allowing the liquid to be sucked therethrough at said flow rate by the currents of compressed air to form respective jet streams of a gas-liquid mixture that impinge upon each other at said point of impingement thereby producing the ultrafine mist.

2. An improvement in an atomizer nozzle assembly as claimed in claim 1, and further comprising particle producing means for limiting the maximum particle diameter of the particles confining the ultrafine mist to a range of 35μ to 50μ when the compressed air is forced through said air jet passages under pressure ranging from 2 $kg/cm^2$ to 5 $kg/cm^2$ while facilitating a uniform atomization rate, said particle producing means comprising respective portions of said forward end portions of each said nozzle tip that project 0.3 mm–0.8 mm from the front end of each of said nozzle heads, respectively.

* * * * *